United States Patent [19]

Nakahata et al.

[11] 4,341,457

[45] Jul. 27, 1982

[54] ELECTROPHOTOGRAPHIC APPARATUS INCLUDING AN ELECTROSTATIC SEPARATION DEVICE

[75] Inventors: Kimio Nakahata, Kawasaki; Koichi Tanigawa; Hiroyuki Adachi, both of Tokyo, all of Japan

[73] Assignee: Canon Kabushiki Kaisha, Tokyo, Japan

[21] Appl. No.: 184,663

[22] Filed: Sep. 8, 1980

[30] Foreign Application Priority Data

Sep. 13, 1979 [JP] Japan ..... 54-117782
Sep. 13, 1979 [JP] Japan ..... 54-117783

[51] Int. Cl.[3] ..... G03G 15/00; G03G 15/16

[52] U.S. Cl. ..... 355/3 CH; 355/3 TR; 355/14 CH; 361/225

[58] Field of Search ..... 355/3 CH, 3 TR, 14 CH, 355/3 R; 250/324–326; 361/225, 229; 271/DIG. 2

[56] References Cited

U.S. PATENT DOCUMENTS 3,950,680 4/1976 Michaels ..... 355/14 CH
4,055,380 10/1977 Borostyan ..... 355/3 TR
4,077,709 3/1978 Borostyan ..... 355/3 TR
4,183,653 1/1980 Satomi et al. ..... 355/3 CH
4,190,348 2/1980 Friday ..... 355/3 CH

*Primary Examiner*—Richard L. Moses
*Attorney, Agent, or Firm*—Fitzpatrick, Cella, Harper & Scinto

[57] ABSTRACT

A transfer corona current is always maintained substantially constant independently of the surface potential of a photosensitive medium and environmental conditions, to thereby prevent the amount of charge on the back side of a transfer medium from fluctuating in accordance with said surface potential and environmental conditions. In addition, a separation corona current is maintained substantially constant to thereby further improve the stability of electrostatic separation. The transfer corona current is below a critical current value whereat the corona charge passes through the transfer medium, and the separation corona imparts to the back side of the transfer medium an amount of charge substantially equal to the amount of charge provided by the transfer corona.

31 Claims, 6 Drawing Figures

ELECTROPHOTOGRAPHIC APPARATUS INCLUDING AN ELECTROSTATIC SEPARATION DEVICE

BACKGROUND OF THE INVENTION

1. Field of the Invention

This invention relates to an electrophotographic apparatus, and more particularly to an improved transfer and electrostatic separating device.

2. Description of the Prior Art

Electrophotographic apparatuses are known which use an image bearing member such as an insulating drum or the like to form an image corresponding to an original. For example, in electrostatic copying machines, it has usually been practised to form a visible image corresponding to an original on a drum-like or belt-like photosensitive medium through a predetermined process, and to transfer the visible image to a transfer medium to thereby obtain a final copy. In this case, as the method of transferring the image, there is a method whereby corona discharge opposite in polarity to the charge retained by fine coloring particles (hereinafter referred to as toner) forming the visible image on the photosensitive medium is applied to the back side of the transfer medium to thereby cause the toner to adhere to the transfer medium to electrostatic attraction, or a method which uses, instead of corona discharge, a roller having a bias voltage applied thereto, to transfer the image on the basis of a principle similar to what has been described above.

When the transfer medium is to be separated from the photosensitive medium, a charge opposite in polarity to the toner is present on the back side of the transfer medium and under the influence of such charge, the transfer medium adheres to the photosensitive medium. Therefore, means is required for overcoming such adhesion force to mechanically separate the transfer medium from the photosensitive medium or for negating the adhesion force itself.

As an example of the former means, there is a method whereby a separating belt member is interposed between the photosensitive medium and the transfer medium and when the transfer medium has passed the transfer area, the belt guides and separates the transfer medium from the photosensitive medium. This method ensures reliable separation of the transfer medium while, on the other hand, it has the disadvantages that a non-image bearing area is created on the final copy and that the separating member contacts the photosensitive medium and is thus liable to damage the surface of the photosensitive medium.

As an example of the latter means, there is a so-called electrostatic separating method whereby the charge on the back side of the transfer medium is negated as by corona discharge to thereby permit the transfer medium to separate from the photosensitive medium due to its own rigidity and weight (U.S. Pat. Nos. 3,575,502 and 3,998,536). As compared with the former method of the contact type, this latter method of the non-contact type has numerous merits including a merit that no blank area is created on the final copy and a merit that the photosensitive medium is not damaged. On the other hand, however, this latter method has a demerit that the adhesion force of the transfer medium to the photosensitive medium resulting from the charge of the back side thereof depends on various factors such as the resistivity and thickness of the transfer medium, the surface potential of the photosensitive medium, atmospheric conditions, etc. and therefore, the reliability of separation is not always high.

In view of this, there has heretofore been proposed a method of changing the separation discharging conditions in accordance with the type of the transfer medium or a method whereby the difference in surface potential of the photosensitive medium corresponding to the black ground portion and the white ground portion of an original (hereinafter referred to as the black original and the white original or the image bearing portion and the non-image bearing portion) is reduced before the transfer charging to prevent the adhesion force of the transfer medium to the photosensitive medium from being greatly varied in accordance with the black original or the white original.

The latter method will hereinafter be described. In that portion of the photosensitive medium surface where the surface potential of the photosensitive medium when contacted by the transfer medium corresponds to the black original (the image bearing portion), for example, the photosensitive medium surface is charged to +600 volts while that corresponding to the white original (the non-image bearing portion) is 0 volt. Next, when corona discharge opposite in polarity to toner, i.e. plus in this case, is effected through the transfer medium, the amount of corona discharge current which is determined by the surface potential of the photosensitive medium and the voltage applied to the corona discharge wire becomes greater for the white original than for the black original. Also, even when the same amount of positive charge exists on the back side of the transfer medium, the static electricity acts so as to cause the transfer medium to adhere more strongly to the photosensitive medium surface having a surface potential of minus tendency and therefore, a transfer medium for the black original can be readily separated but separation of a transfer medium for the white original is difficult under the separation discharging conditions for the black original.

To eliminate such difficulty, the step of converging the surface potential of the photosensitive medium to a predetermined value before the image transfer may be incorporated. More specifically, there has been proposed a method of reducing this surface potential difference by using a charger (U.S. Pat. No. 3,357,400) or a method of obtaining the same result by applying a bias light to the photosensitive medium. It is known that the difference in separation performance resulting from the difference between the black and white of an original can be improved by these methods, but to achieve such purpose, means such as a charger or a lamp must additionally be provided and this would lead to bulkiness or complication of the apparatus. Also, completely eliminating the surface potential difference resulting from the black original and the white original by the charging before the image transfer would become more difficult for a high speed copying process and moreover, the elimination of the potential difference by application of the light of a lamp or the like would result in insufficient discharging at the potential of the black original in which toner is present.

SUMMARY OF THE INVENTION

It is an object of the present invention to provide an electrophotographic apparatus having an improved transfer and electrostatic separation device.

It is another object of the present invention to provide an electrophotographic apparatus which effects image transfer by a substantially constant transfer current irrespective of the image bearing portion or the non-image bearing portion of the photosensitive medium.

It is still another object of the present invention to provide an electrostatic separating device improved so that image transfer and separation are stabilized even when there is a potential difference on the surface of the photosensitive medium corresponding to the black ground and the white ground of an original.

It is yet still another object of the present invention to provide an electrostatic separating device having stable transfer and separation performances even for any fluctuation of the atmospheric conditions.

It is a further object of the present invention to provide a transfer and electrostatic separation device applicable to a high speed electrophotographic apparatus.

It is a further object of the present invention to provide an electrostatic separating device which can effect separation of transfer medium under predetermined separation conditions irrespective of differences in type, thickness, etc. of the transfer medium.

The above objects may be achieved by always maintaining the transfer corona current substantially constant independently of the surface potential of the photosensitive medium and atmospheric conditions (temperature, humidity, etc.) and preventing the amount of charge on the back side of the transfer medium from fluctuating in accordance with the surface potential of the photosensitive medium and atmospheric conditions. In addition, by maintaining the current value of the separation corona discharge substantially constant, the stability of electrostatic separation is further improved. To obtain constant currents for the transfer and the separation corona discharge, constant current power sources may be used as the power sources are used and, if constant current difference power sources in which the difference between the positive and negative component of AC is always maintained constant, there will be an excellent advantage that a more stable discharge can be effected. Also, by making the inner wall of the shield plates of the transfer and separation corona dischargers insulative, it is possible to reduce the discharging current flowing to the shield plates and maintain the discharging current flowing toward the photosensitive medium substantially constant irrespective of the difference in latent image potential of the photosensitive medium.

Also, transfer corona discharge is effected at a charge amount below a critical charge amount whereat the charge by transfer corona begins to pass through the transfer medium to the surface of the photosensitive medium. This can solve the disadvantage peculiar to the prior art that the separation conditions had to be changed depending on the type of the transfer medium and temperature and humidity. Thereafter, separation corona discharge of a charge amount substantially equal to the transfer corona charge amount may further be imparted to the transfer medium to enhance the reliability of separation.

The above and other objects and features of the present invention will become more fully apparent from the following detailed description taken in conjunction with the accompanying drawings.

DESCRIPTION OF THE PREFERRED EMBODIMENTS

Embodiments of the present invention will hereinafter be described with reference to the drawings and tables.

Figure 1:
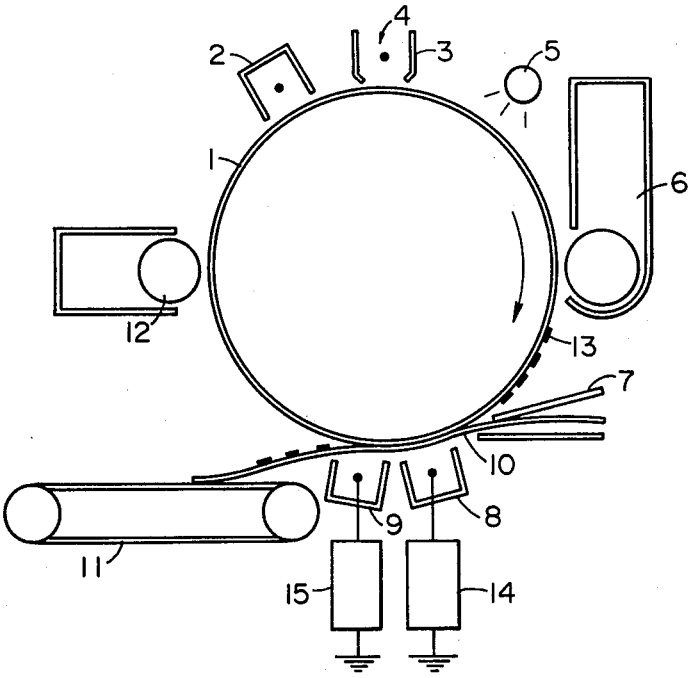
FIG. 1 is a schematic view of an electrophotographic copying machine including the electrostatic separating device according to the present invention.

Referring to FIG. 1 which is a schematic view of an electrophotographic copying machine including the electrostatic separating device according to the present invention, reference numeral 1 designates a photosensitive drum using an N type CdS-binder photosensitive medium and having an insulating layer on the surface thereof. Reference numeral 2 denotes a primary corona charger of the polarity different from that of the carrier of the photosensitive medium, namely, of the positive polarity, reference numeral 3 an AC corona discharger, reference numeral 4 an image exposure, reference numeral 5 a whole surface exposure lamp, reference numeral 6 a developing device, reference numeral 7 a paper supply guide, reference numeral 8 an image transfer corona discharger, reference 9 a separation corona discharger, reference numeral 10 transfer paper, reference numeral 11 conveyor means for separated transfer paper 10, and reference numeral 12 surface cleaning means for the photosensitive drum 1.

In this copying machine, an electrostatic latent image is formed on the photosensitive drum 1 through the process of discharging by the primary corona discharger simultaneous with the exposure, and whole surface exposure, whereafter the electrostatic latent image is developed into a visible image 13 by the developing device 6. This visible image 13 is electrostatically attracted onto the transfer paper 10 by the image transfer corona discharger 8, and the back side charge of the transfer paper 10 created during that time is erased by the separation corona discharger 9, and the transfer paper 10 is separated from the photosensitive drum 1. Designated by 14 and 15 are power sources connected to the image transfer corona discharger 8 and the separation corona discharger 9, respectively.

Here, the correlations among the surface potential of the photosensitive drum 1 before the image transfer, the transfer corona current value, the separation corona current value and the separation of the transfer paper 10 are shown by comparing the experiment results in a conventional case (Table 1A) where a minus constant voltage power source has been used as the separation corona and a case (Table 1B) where the present invention has been carried out to use the image transfer corona power source as the constant current power source.

TABLE 1A

| | Constant voltage for both image transfer and separation | |
|---|---|---|
| | Black original (surface potential 300 V) | White original (surface potential OV) |
| Transfer corona current | 40 [μA] | 50 |
| Separation corona current | 30 | 25 |
| Separation of transfer medium | O | X |

TABLE 1B

| | Transfer: Constant current, Separation: Constant voltage | |
|---|---|---|
| | Black original (surface potential 300 V) | White original (surface potential OV) |
| Transfer corona current | 40 [μA] | 40 |
| Separation corona current | 30 | 20 |
| Separation of transfer medium | O | O |

O: good separation
X: bad separation

These tables show a case where the difference in surface potential of the photosensitive medium before image transfer between a black original and a white original is 300 V. Where a constant voltage power source is used as the image transfer corona as has been conventional, under the condition in which the transfer paper is separated for a black original, the amount of corona discharge fluctuates in the direction in which the image transfer corona current increases for a white original and the force attracting the transfer paper to the photosensitive medium increases in the direction in which the separation corona current decreases and cannot completely remove the back side charge of the transfer paper. Therefore, as shown in Table 1A, the transfer paper is separated for a black original but cannot be separated for a white original.

In contrast, if the present invention is carried out to maintain the image transfer current substantially constant, there will be obtained the result as shown in Table 1B. That is, the disadvantage that the amount of image transfer current is increased for a white original than for a black original as in the prior art whereby the transfer paper is more strongly attracted to the photosensitive medium (Table 1A) is prevented by making the amount of image transfer current constant and the transfer medium becomes separable even in the case of a white original. In this case, by the amount by which the surface potential of the white original is lower than that of the black original, the separation current decreases for the white original and acts in a direction to weaken the separation and the degree thereof depends on the surface potential difference of the photosensitive medium between the black original and the white original. Where the surface potential difference is about 300 V as shown in Table 1A and 1B, the separation is effected reliably even if the separation corona current fluctuates more or less.

In a copying machine having a latent image of high contrast, simply making the image transfer corona current into a constant current is not sufficient.

TABLE 2A

| | Constant voltage for both image transfer and separation | |
|---|---|---|
| | Black original (surface potential 600 V) | White original (surface potential OV) |
| Transfer corona current | 40 [μA] | 60 |
| Separation corona current | 30 | 25 |
| Separation of transfer medium | O | X |

TABLE 2B

| | Transfer: Constant current, Separation: Constant voltage | |
|---|---|---|
| | Black original (surface potential 600 V) | White original (surface potenital OV) |
| Transfer corona current | 40 [μA] | 40 |
| Separation corona current | 30 | 10 |
| Separation of transfer medium | O | X |

TABLE 2C

| | Constant current for both image transfer and separation | |
|---|---|---|
| | Black original (surface potential 600 V) | White original (surface potential OV) |
| Transfer corona current | 40 [μA] | 40 |
| Separation corona current | 30 | 30 |
| Separation of transfer medium | O | O |

O: good separation
X: bad separation

Tables 2 above show the image transfer separation characteristic when the surface potential difference of the photosensitive medium between a black original and a white original is 600 V. In this case, the image transfer corona is made into a constant current, and it is not possible to separate both transfer papers corresponding to the black original and the white original (Table 2B), but the separation is rendered possible by also making the separation corona current also into a constant current (Table 2C). That is, where both the transfer corona and the separation corona are maintained at constant voltages (Table 2A) or where only the transfer corona is made into a constant current and the separation corona is made into a constant voltage (Table 2B), the back side charge of the transfer medium is not sufficiently erased due to a deficient amount of separation discharging and thus, the transfer medium is not separated from the photosensitive medium. However, where both the transfer corona and the separation corona are made into constant currents (Table 2C), the amount of separation discharging becomes sufficient even for a white original whereby the attraction of the transfer paper to the photosensitive medium is weakened and the transfer paper separates from the photosensitive medium by its own rigidity and weight.

As described above, according to the present invention, it is apparent that the reliability of electrostatic separation is enhanced by suitably controlling the balance between the transfer corona current and the separation corona current. This is effective not only for the above-described balance change resulting from the surface potential of the photosensitive medium but also for the fluctuation of the corona discharging current resulting, for example, from a change in atmospheric condition.

Table 3 below shows examples of the good or bad separation resulting from a fluctuation of the atmospheric condition.

TABLE 3

| | 25° C. 60% RH | 5° C. 20% RH Case of constant voltage | 5° C. 20% RH Case of constant current |
|---|---|---|---|
| Transfer corona current | 40 [μA] | 45 | 40 |
| Separation corona current | 30 | 60 | 30 |
| Separation of transfer medium | O | X | O |

O: good separation
X: bad separation

Assuming that the transfer corona current is plus and the separation corona current is minus in the above table, when separation is electrostatically possible at normal temperature and normal humidity (25° C., 60%), and if the atmosphere changes to a low temperature and low humidity (5° C., 20%) where the conventional constant voltage power source is used, then the corona discharging current also fluctuates and this fluctuation rate does not coincide between the plus corona and the minus corona and therefore, separation of transfer paper cannot take place in some cases. Even when there is such an environmental fluctuation, if the discharging current is controlled constant by a constant current power source, very stable electrostatic separation can be accomplished.

In carrying out the present invention, constant current high voltage power sources are used as the transfer corona and separation corona power sources 14 and 15 (FIG. 1). To enable transfer medium to be separated normally, the above-described remarkable effect can be achieved simply by thus making the power sources into constant current power sources.

However, since the shield plates of the transfer and separation corona discharges are usually made of a metal and grounded, the sum of a current ($I_p$) flowing from the discharge wire to the photosensitive medium and a current ($I_s$) flowing to the shield plates becomes a constant current and, if there is a surface potential difference on the photosensitive medium corresponding to a white original and a black original, said $I_p$ will fluctuate. $I_s$ increases or decreases so as to complement the fluctuation of the $I_p$ and as a result, a constant current flows to the discharging circuit, but the current $I_p$ actually flowing toward the photosensitive medium differs from the white original to the black original which is not desired.

To solve this problem, the inner walls of the shield plates may be provided with insulating coating or the shield plates themselves may be formed of an insulating material. If such construction is adopted, the current $I_s$ flowing to the shield plates becomes smaller and, irrespective of the difference between the white original and the black original, the current $I_p$ flowing to the photosensitive medium becomes constant, thus further increasing the stability of the separation.

The power source is not restricted to the above-described DC constant current power source, but may be an AC power source or a so-called constant current difference power source having a feedback circuit for superposing a DC power source upon the AC power source described in our prior U.S. patent application Ser. No. 798,040 and for maintaining the component difference between the current components thereof constant. Stably supplying several tens of μA of discharging current by a DC constant current power source cannot be said to be very easy, but in the aforementioned constant current difference power source, control is effected so that the difference between the positive and the negative component is several tens of μA and this leads to an advantage that stable corona discharge can always be accomplished.

Table 4 below shows an example of the experiment carried out when a constant current difference power source comprising a DC plus power source superposed upon an AC power source has been used for the transfer corona discharge and a constant current difference power source using only an AC power source has been used for the separation corona discharge. Separation has been good both for a black original and a white original.

It is most preferable to use a DC constant current power source for the transfer corona and for the separation corona to use a constant current difference power source having a feedback circuit for superposing DC upon AC and maintaining the difference between the positive and negative current components of the corona discharging current substantially constant. This is because, in the image transfer, disturbance of the image can be prevented by applying a strong electric field for a short time by DC and because, in the separation, the back transfer of toner to the photosensitive medium can be prevented by widely applying a weak electric field by AC. In this case, to stabilize the discharging, the shield of the discharger is formed of an insulator, but the inner surface of the conductive shield should preferably be covered with an insulating film or paint. Particularly, in the separation using AC, it would be effective to make the shield itself of an insulator.

TABLE 4

| | | Black original (surface potential 600 V) | White original (surface potential OV) | Remarks |
|---|---|---|---|---|
| Transfer corona current | Positive component | 230 [μA] | 180 | Use has been made of a constant current difference power source comprising DC plus source superposed on AC power source |
| | Negative component | 190 | 140 | |
| | Current difference | 40 | 40 | |
| Separation corona current | Positive component | 120 | 190 | Use has been made of a constant current difference power |
| | Negative component | 150 | 220 | |
| | Current difference | 30 | 30 | |

TABLE 4-continued

| | Black original (surface potential 600 V) | White original (surface potential OV) | Remarks |
|---|---|---|---|
| | | | source using only an AC power source |
| Separation of transfer medium | O | O | — |

O: good separation
X: bad separation

Figure 2:
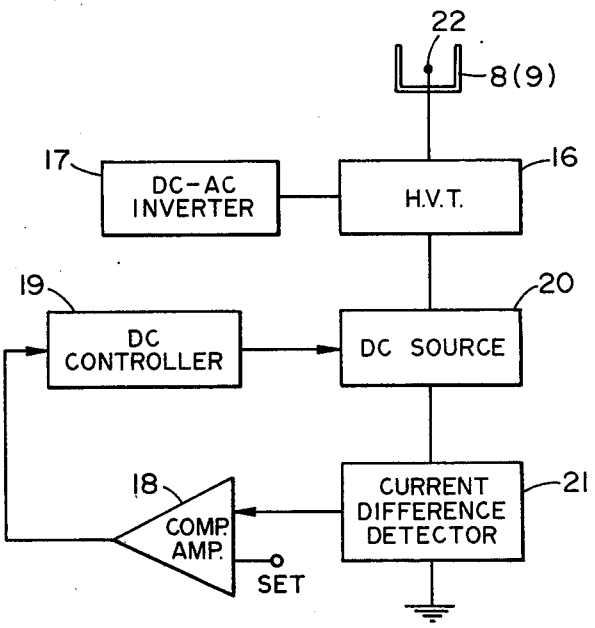
FIG. 2 is a schematic diagram showing an embodiment of the constant current difference power source.

FIG. 2 is a schematic diagram of an embodiment of such constant current difference power source. In FIG. 2, reference numeral 16 designates an AC transformer, reference numeral 17 denotes a DC-AC inverter, reference numeral 18 designates a comparison amplifier, reference numeral 19 denotes a DC controller, and reference numeral 20 designates a DC source.

In this construction, when AC corona discharge is effected, the current difference $\Delta I$ of a high voltage output is detected as a DC component by a current difference detector 21 and, if this differs from a predetermined value $\Delta Is$, feedback is effected so that the output from the DC source is varied by the DC controller 19 so as to be maintained at a predetermined set value. Accordingly, a stable constant current is always supplied to the discharge wire 22 of the corona discharger 8 (or 9).

If a constant current difference power source is used for such AC corona discharge, even if the total current amount of the AC discharge fluctuates, the difference between the positive and the negative component current of that discharging current can be rendered substantially constant independently of the fluctuation of the surface potential of the photosensitive medium and the variation in atmospheric conditions and therefore, the same effect as that of the above-described DC constant current power source can also be achieved.

By using AC corona discharge, the following merits appear as compared with DC corona discharge.

Firstly, to maintain constant the corona current toward the photosensitive medium, the inner wall of the shield plates may be made insulative as described above, but in the case of DC corona discharge, the corona discharge toward the insulative shield is stopped and therefore, the total current amount is $\frac{1}{2}$ to $\frac{1}{3}$ as compared with the case of a grounded metal shield and this readily gives rise to irregularity of corona discharge. This may be prevented as by using a grid, but where there is a grid, the corona current flowing to the surface of the photosensitive medium is affected by the surface potential of the photosensitive medium and this is not suitable for the purpose of the present invention. In contrast, in the case of AC corona discharge, corona discharge is effected for the insulative shield as well and therefore, in the case of AC corona discharge, under the condition that the current toward the photosensitive medium is the same, a total current amount of corona discharge four to six times as great as that of DC corona discharge is obtained and uniform corona discharge is obtained even in the case of the insulative shield. Also, if, in a constant current difference power source comprising a DC source superposed upon an AC source, the polarity and voltage range of the DC source are suitably selected, the total current amount can be increased while the difference between the positive and the negative current component can be reduced. This difference in discharge irregularity between DC corona and AC corona is particularly remarkable in a case where use is made of a weak corona discharge whose applied voltage to the corona discharge wire is relatively low and close to the discharge starting voltage, and more specifically, in the case of separation corona discharge or the like.

Secondly, where an insulative shield is used, the amount of AC corona discharge toward the shield is equal with respect both to the positive and the negative and all the current difference between the positive and the negative of the corona discharge current flows toward the photosensitive medium and therefore, irrespective of the shape of the discharger, stable imparting of charge toward the photosensitive medium becomes possible and this, coupled with the first-mentioned merit, can produce effective electrostatic separation.

Thirdly, in electrostatic separation, there is a phenomenon that toner once transferred from a photosensitive medium is transferred back to the photosensitive medium by the action of the electric field during separation discharging. This is particularly remarkably observed at the leading end portion of transfer paper, but if AC corona discharge is used, this phenomenon is alleviated as compared with the case where DC corona discharge is used. This is considered to be attributable to the fact that the mechanism for discharging the transfer paper by the amount of subtraction between the positive and the negative charge through repetition of charging and back charging of AC corona discharge dulls the re-transfer of the toner to the photosensitive medium, as compared with the DC corona discharge which discharges at a stroke.

As has hitherto been described in detail, the purpose of the present invention is to reliably effect electrostatic separation by making at least the discharging current of transfer corona into a constant current. If, at this time, the separation corona discharging current is also made into a constant current, a more stable separating operation may be accomplished. Incidentally, it is conceivable to use the conventional constant voltage power source for the transfer corona discharge and to make only the separation corona discharge into a constant current. In this case, however, as seen from Table 1A and Table 2A, the transfer corona current value greatly differs from a black original to a white original and, even if the separation current is maintained constant, it is very difficult to effect reliable separation irrespective of the black and white originals.

As described above in detail, in the above-described embodiment of the present invention, the transfer corona current or the transfer and separation corona currents are maintained substantially constant and this leads to the provision of an electrostatic separating method and apparatus which ensures stable separation of transfer medium without using any additional means such as a corona discharger and a bias light source for reducing the surface potential difference of the photosensitive medium for a black and a white original before the image transfer, as has heretofore been required, and without being affected by any fluctuation of the atmosphere.

Figure 3:
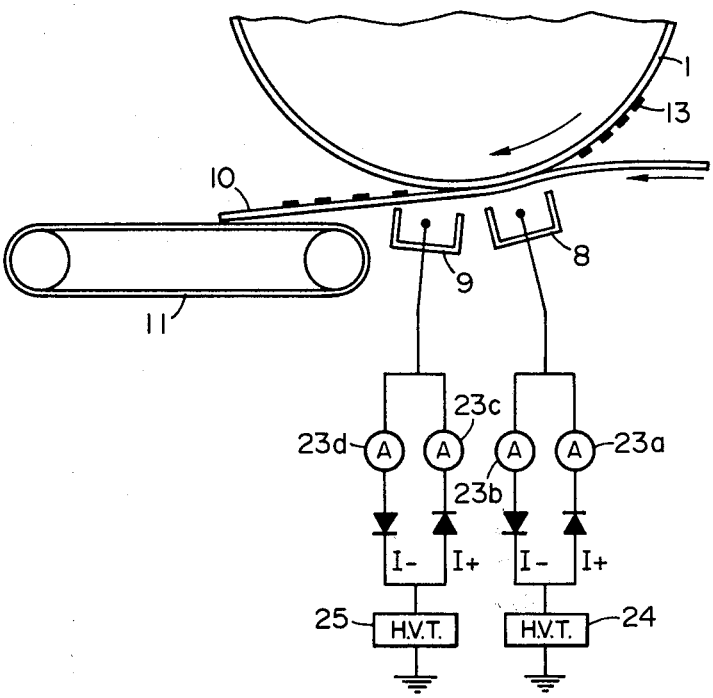
FIG. 3 is a schematic view of an experiment which provides the basis of the present invention.

Another embodiment of the present invention will be described with reference to FIG. 3. Referring to FIG. 3 which is a schematic view of an experimental device which is the basis of the present invention, reference numeral 8 designates a transfer corona discharger, reference numeral 9 denotes a separation corona discharger, reference numeral 10 designates transfer paper, reference numeral 13 denotes a visible image formed of toner, and reference numeral 1 designates a photosensitive drum. The visible image 13 formed on the photosensitive drum 1 through a predetermined process is transferred onto the transfer paper 10 by transfer corona discharge. During the image transfer, a charge opposite in polarity to the toner forming the visible image 13 is imparted to the back side of the transfer paper 10 and the visible image 13 is transferred to the transfer paper by the electrostatic attraction of that charge. Simultaneously therewith, the transfer paper 10 itself is brought into intimate contact with the photosensitive medium 1 by the attraction of the back side charge of the transfer paper and the charge induced thereby on the back side of the photosensitive drum. Then, the amount of charge on the back side of the transfer paper 10 is decreased by the separation corona discharger 9 and the transfer paper is separated from the photosensitive drum 1 by the gravity and rigidity of the paper itself.

The device of FIG. 3 is an experimental device for examining the correlation between the combination of the transfer current and the separation current and the separating performance in a method of separating the transfer paper from the photosensitive drum by the utilizing the above-described decrease in the electrostatic attraction. That is, both the transfer corona discharger 8 and the separation corona discharger 9 have the whole or only the inner surface of their shield plates formed as insulative, and the amount of current directed to the photosensitive drum 1 is read by each of ammeters 23*a*–23*d*. The power sources 24 and 25 for the respective corona dischargers may use DC or AC or DC and AC superposed upon each other. In the case of DC corona discharge, the read current value itself is the effective current value acting for transfer and separation, but in the case of AC corona discharge or corona discharge using DC superposed upon AC, if the difference between the positive and negative current components (I+, I−) is the effective current amount, the transfer and separation performance may be regarded as generally similar to those in the case of DC corona. As the power source of FIG. 3, use is made of a current source in which the difference between I+ and I− is constant, namely, a so-called constant current difference power source. The constant current difference power source is described in the aforementioned U.S. patent application Ser. No. 798,040 and therefore need not be described in detail herein. Also, where the shield plates of the corona dischargers are grounded metal, the total current amount from the corona discharge wire minus the current amount flowing to the shield plates is the transfer or separation current so referred to herein.

Figure 4:
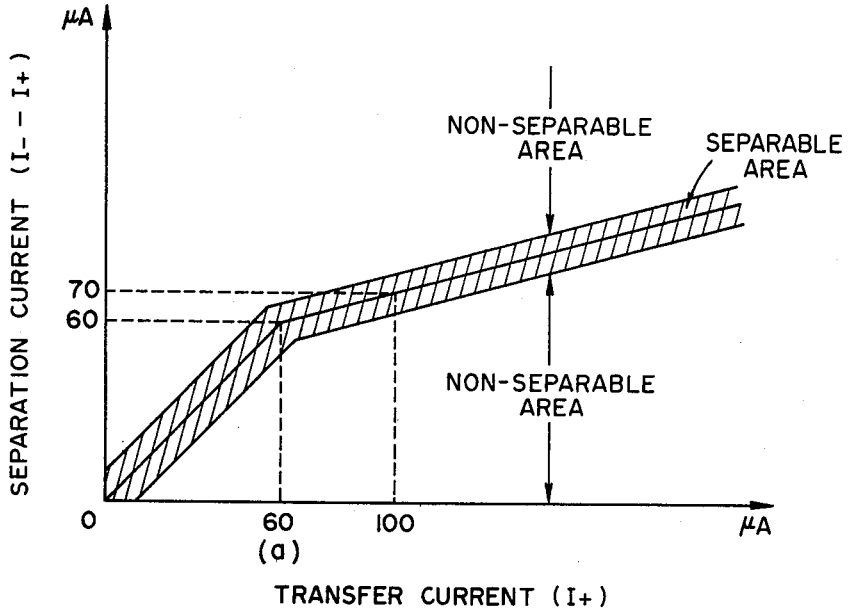
FIG. 4 is a graph of an actual measurement showing the separable range by combination of a transfer current and a separation current.

FIG. 4 is a graph in which the transfer current and the separation current have been measured by the construction of FIG. 3. Here, plus DC corona discharge is used for the transfer, and AC corona discharge is used for the separation. It is characteristic that separation is effected under the condition that transfer current = separation current until the transfer current reaches a certain critical value (point a), whereas for the transfer current greater than that, the condition for separation becomes transfer current > separation current. Of course, in accordance with the rigidity, gravity, etc. of the transfer paper 10, the separable area has a certain extent as indicated by hatching in FIG. 4. The above-described tendency which the separation current exhibits for the transfer current in the separable area is established for transfer paper having various different parameters such as resistivity, thickness, rigidity, etc.

Figure 5A:
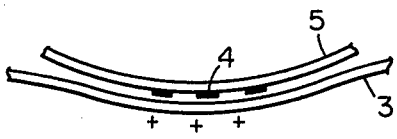
FIGS. 5A and 5B are conceptional views showing the physical meaning of the critical current amount (point a).
Figure 5B:
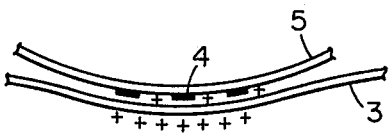

The present invention provides a stable electrostatic separating method on the basis of the above-described observed fact. This is achieved by maintaining the amount of transfer current below the critical point (point a) exhibited by the transfer paper used. The physical meaning of the critical point (a) is such as shown in FIG. 5. That is, for a transfer current below the critical point, charge is stored mainly on the back side of the transfer paper 10 (FIG. 5A). On the other hand, when the transfer current exceeds the critical point, some transfer corona charge passes through the transfer paper to the surface of the photosensitive drum 1 and the amount of charge remaining on the back side of the transfer paper is less than the total charge amount of tranfer corona discharge (FIG. 5B). It is therefore considered that for a transfer current exceeding the critical point, an equivalent separation current would erase the back side charge and in addition, the transfer paper would be reversely charged and become non-separable.

Therefore, if the amount of transfer current is maintained below the critical point, depending on the type of the transfer paper, the amount of corona current passing through the transfer paper fluctuating to vary the charge amount remaining on the back side of the transfer paper may be prevented, and there will be provided the basis on which separation of a great variety of transfer papers becomes possible under a predetermined separation corona condition. If this is compared with a case where image transfer is effected by an amount of transfer current exceeding the critical point, the superiority of the present invention will be apparent. That is, the corona current amount passing through the transfer paper (the critical current amount) differs depending on the type of the transfer paper, and the charge amount to be removed from the back side of the transfer paper varies depending on the type of the transfer paper, and it has heretofore been necessary to select a separation condition corresponding thereto, but according to the present invention, such cumbersomeness is eliminated by setting the transfer corona current below the minimum critical current amount exhibited in each usage condition of the transfer paper used.

Also, in an environment of low humidity, the resistance of transfer paper becomes high and the corona current having passed through the transfer paper comes to remain on the back side of the transfer paper, and this has heretofore been an unstable factor in the electrostatic separating method. It is also apparent that such disadvantage is eliminated by the electrostatic separating method of the present invention which eliminates the corona current passing through the transfer paper.

According to the present invention, as previously described, the transfer corona discharger is operated below the critical value (point a) of the transfer corona charge amount and also a separation corona charge amount substantially equal to the transfer corona charge amount is imparted to the transfer medium to effect electrostatic separation. In FIG. 4, the hatching area on the left of the is shown. What is further characteristic is that among the charge amounts in substantially equivalent hatching areas, the area in which transfer≧separation is particularly preferable. If this is to be numerically expressed, it is to render the separation current to about 60–100% of the transfer current. This is because, when the separation current is too strong as compared with the transfer current, the electrostatic adherence force becomes mull and toner comes away from the transfer medium. Incidentally, an experiment shows that good transfer and separation free of disturbance of image and free of reversion of toner can be accomplished by 30 μA of transfer current and 25 μA of separation current.

By the above-described embodiments of the present invention, it becomes possible to fundamentally improve the electrostatic separating method in which the separation condition had to be changed in accordance with the type of the transfer paper and which had an unstable factor for fluctuation of the environment.

In the above-described embodiments of the present invention, a photosensitive medium has been shown as the image bearing member, whereas of course, it is also possible to use, for example, an insulating drum or the like used in the screen process wherein a first electrostatic latent image is formed on a photosensitive screen and the first latent image is ion-modulated to form a second electrostatic latent image.

What we claim is:

1. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member; and means for maintaining substantially constant the amount of charge imparted to the transfer medium by said transfer corona discharge irrespective of charges on the image bearing portion or the non-image bearing portion of said image bearing member.

2. An apparatus according to claim 1, further comprising means for maintaining substantially constant the amount of charge imparted to the transfer medium by said separation corona discharge irrespective of the image bearing portion or the non-image bearing portion of said image bearing member.

3. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the amount of charge imparted to the transfer medium by said transfer corona discharge irrespective of charges on the image bearing portion or the non-image bearing portion of said image bearing member; and means for maintaining substantially constant the amount of said charge imparted to the transfer medium by said separation corona discharge irrespective of charges on the image bearing portion or the non-image bearing portion of said image bearing member;

wherein said means for maintaining the amount of said separation corona discharge substantially constant is a DC power source having a constant current characteristic.

4. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the amount of charge imparted to the transfer medium by said transfer corona discharge irrespective of charges on the image bearing portion of the non-image bearing portion of said image bearing member; and means for maintaining substantially constant the amount of said charge imparted to the transfer medium by said separation corona discharge irrespective of charges on the image bearing portion or the non-image bearing portion of said image bearing member;

wherein said means for maintaining the amount of said separation corona discharge substantially constant is a constant current difference power source provided with a feedback circuit for maintaining the difference between the positive and the negative current component of an AC corona discharge current substantially constant.

5. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the amount of charge imparted to the transfer medium by said transfer corona discharge irrespective of charges on the image bearing portion or the non-image bearing portion of said image bearing member; and means for maintaining substantially constant the amount of said charge imparted to the transfer medium by said separation corona discharge irrespective of charges on the image bearing portion or the non-image bearing portion of said image bearing member;

wherein said means for maintaining the amount of said separation corona discharge substantially constant is a constant current difference power source in which DC is superposed upon AC and which is provided with a feedback circuit for maintaining the difference between the positive and the negative current component of the corona discharge current substantially constant.

6. An apparatus according to claim 3, 4, or 5, wherein said means for maintaining the amount of said transfer corona discharge substantially constant is a DC power source having a constant current characteristic.

7. An apparatus according to claim 3, 4 or 5, wherein said means for maintaining the amount of said transfer corona discharge substantially constant is a constant current difference power source provided with a feedback circuit for maintaining the difference between the positive and the negative current component of an AC corona discharge current substantially constant.

8. An apparatus according to claim 3, 4 or 5, wherein said means for maintaining the amount of said transfer corona discharge substantially constant is a constant current difference power source in which DC is superposed upon AC and which is provided a feedback circuit for maintaining the difference between the positive and the negative current component of the corona discharge current substantially constant.

9. An apparatus according to claim 3, 4 or 5, wherein the whole or the inner surface of the shield plate of said transfer corona discharge means is insulative.

10. An apparatus according to claims 3, 4 or 5, wherein the whole or the inner surface of the shield plate of said separation corona discharge means is insulative.

11. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium; and means for applying from the back side of the transfer medium a corona discharge substantially opposite in polarity to said transfer corona discharge to thereby separate the transfer medium from the surface of said image bearing member;

wherein the amount of the transfer corona charge imparted to the back side of the transfer medium is maintained less than a critical value whereat the transfer corona passes through the transfer medium to the surface of said image bearing member, and wherein a separation corona discharge providing an amount of charge substantially equal to the amount of said transfer corona charge is imparted to the transfer medium to thereby effect separation.

12. An apparatus according to claim 11, further comprising means for maintaining the transfer corona current substantially constant.

13. An apparatus according to claim 12, further comprising means for maintaining the separation corona current substantially constant.

14. An apparatus according to claim 12 or 13, wherein said means for maintaining the transfer corona current substantially constant is a DC power source having a constant current characteristic.

15. An apparatus according to claim 12 or 13, wherein said means for maintaining the transfer corona current substantially constant is a constant current difference power source provided with a feedback circuit for maintaining the difference between the positive and the negative current component of an AC corona discharge current substantially constant.

16. An apparatus according to claim 12 or 13, wherein said means for maintaining the transfer corona current substantially constant is a constant current difference power source in which DC is superposed upon AC and which is provided with a feedback circuit for maintaining the difference between the positive and the negative current component of the AC corona discharge current substantially constant.

17. An apparatus according to claim 12 or 13, wherein the whole or the inner surface of the shield plate of said transfer corona discharge means is insulative.

18. An apparatus according to claim 13, wherein said means for maintaining the separation corona current substantially constant is a DC power source having a constant current characteristic.

19. An apparatus according to claim 13, wherein said means for maintaining the separation corona current substantially constant is a constant current difference power source provided with a feedback circuit for maintaining the difference between the positive and the negative current component of an AC corona discharge current substantially constant.

20. An apparatus according to claim 13, wherein said means for maintaining the separation corona current substantially constant is a constant current difference power source in which DC is superposed upon AC and which is provided with a feedback circuit for maintaining the difference between the positive and the negative current component of the corona discharge current substantially constant.

21. An apparatus according to claim 13, wherein the whole or the inner surface of the shield plate of said separation corona discharge means is insulative.

22. An electrophotographic apparatus comprising:

an electrophotographic photosensitive medium;

means for forming an electrostatic latent image on said photosensitive medium;

developing means for developing the latent image on said photosensitive medium;

a transfer corona discharger for imparting a charge to the back side of a transfer medium by corona discharge to thereby transfer the developed image on said photosensitive medium to the transfer medium;

a separation corona discharged for applying to the back side of the transfer medium, a corona discharge substantially opposite in polarity to said transfer corona discharge to thereby separate the transfer medium from the surface of said photosensitive medium;

a DC power source having a constant current characteristic for maintaining substantially constant the amount of charge imparted to the transfer medium by said transfer corona discharge irrespective of the image bearing portion or the non-image bearing portion of said photosensitive medium; and a constant current difference power source in which DC is superposed upon AC and which is provided with a feedback circuit for maintaining the difference between the positive and the negative current component of the corona discharge current substantially constant, said constant current difference power source being for maintaining substantially constant the amount of charge imparted to the transfer medium by said separation corona discharge irrespective of the image bearing portion or the non-image bearing portion of said photosensitive medium;

the whole of and wherein the shield plates of said transfer corona discharger and said separation corona discharger or the inner surface of a conductive shield plate is insulative.

23. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity of said transfer corona discharge to thereby separate the transfer medium from the surface of said image bearing member; and means for maintaining substantially constant the amount of charge imparted to the transfer medium by said transfer corona discharge irrespective of charges on the image bearing portion or the non-image bearing portion of said image bearing member;

wherein said means for maintaining the amount of said transfer corona discharge substantially constant is a constant current difference power source provided with a feedback circuit for maintaining the difference between the positive and the negative current component of an AC corona discharge current substantially constant.

24. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the amount of charge imparted to the transfer medium by said transfer corona discharge irrespective of charges on the image bearing portion or the non-image bearing portion of said image bearing member;

means for maintaining substantially constant the amount of said charge imparted to the transfer medium by said separation corona discharge irrespective of charges on the image bearing portion or the non-image bearing portion of said image bearing member;

wherein said means for maintaining the amount of said transfer corona discharge substantially constant is a constant current difference power source provided with a feedback circuit for maintaining the difference between the positive and the negative current component of an AC corona discharge current substantially constant.

25. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member; and means for maintaining substantially constant the amount of charge imparted to the transfer medium by said transfer corona discharge irrespective of charges on the image bearing portion or the non-image bearing portion of said image bearing member;

wherein said means for maintaining the amount of said transfer corona discharge substantially constant is a constant current difference power source in which DC is superposed upon AC and which is provided a feedback circuit for maintaining the difference between the positive and the negative current component of the corona discharge current substantially constant.

26. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the amount of charge imparted to the transfer medium by said transfer corona discharge irrespective of charges on the image bearing portion or the non-image bearing portion of said image bearing member;

means for maintaining substantially constant the amount of said charge imparted to the transfer medium by said separation corona discharge irrespective of charges on the image bearing portion or the non-image bearing portion of said image bearing member;

wherein said means for maintaining the amount of said transfer corona discharge substantially constant is a constant current difference power source in which DC is superposed upon AC and which is provided a feedback circuit for maintaining the difference between the positive and the negative current component of the corona discharge current substantially constant.

27. An apparatus according to claims 23, 24, 25 or 26, wherein the whole or the inner surface of the shield plate of said transfer corona discharge means is insulative.

28. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the amount of charge imparted to the transfer medium by said transfer corona discharge irrespective of charges on the image bearing portion or the non-image bearing portion of said image bearing member; and means for maintaining substantially constant the amount of said charge imparted to the transfer medium by said separation corona discharge irrespective of charges on the image bearing portion or the non-image bearing portion of said image bearing member;

wherein said means for maintaining the amount of said transfer corona discharge substantially constant is a DC power source having a constant current characteristic, and wherein the whole or the inner surface of the shield plate of said transfer corona discharge means is insulative.

29. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the current imparted to the transfer medium by said transfer corona discharge irrespective of charges on the image bearing portion or the non-image bearing portion of said image bearing member; and means for maintaining substantially constant the current imparted to the transfer medium by said separation corona discharge irrespective of charges on the image bearing portion or the non-image bearing portion of said image bearing member;

wherein said means for maintaining said transfer corona current substantially constant is a DC power source having a constant current characteristic.

30. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the current imparted to the transfer medium by said transfer corona discharge irrespective of charges on the image bearing portion or the non-image bearing portion of said image bearing member; and means for maintaining substantially constant the current imparted to the transfer medium by said separation corona discharge irrespective of charges on the image bearing portion or the non-image bearing portion of said image bearing member;

wherein said means for maintaining said separation corona current substantially constant is a constant current difference power source provided with a feedback circuit for maintaining the difference between the positive and the negative current component of an AC corona discharge current substantially constant.

31. An electrophotographic apparatus comprising:

an image bearing member having a latent image on the surface thereof;

developing means for developing the latent image on said image bearing member;

means for imparting a charge to the back side of a transfer medium by corona discharge to thereby transfer the developed image on said image bearing member to the transfer medium;

means for applying to the back side of the transfer medium a corona discharge substantially opposite in polarity to said transfer corona discharge to thereby separate the transfer medium from the surface of said image bearing member;

means for maintaining substantially constant the current imparted to the transfer medium by said transfer corona discharge irrespective of charges on the image bearing portion or the non-image bearing portion of said image bearing member; and means for maintaining substantially constant the current imparted to the transfer medium by said separation corona discharge irrespective of charges on the image bearing portion or the non-image bearing portion of said image bearing member;

wherein said means for maintaining said separation corona current substantially constant is a constant current difference power source in which DC is superposed upon AC and which is provided with a feedback circuit for maintaining the difference between the positive and the negative current component of the corona discharge current substantially constant.

* * * * *

UNITED STATES PATENT AND TRADEMARK OFFICE

CERTIFICATE OF CORRECTION

PATENT NO. : 4,341,457

DATED : July 27, 1982

INVENTOR(S) : KIMIO NAKAHATA, ET AL.

It is certified that error appears in the above—identified patent and that said Letters Patent is hereby corrected as shown below:

COLUMN 3

Line 39, after "sources" (second occurrence) delete "are used".

Line 40, after "sources" insert --are used,--.

COLUMN 6

Line 44, delete "also".

COLUMN 11

Line 37, after "by" delete "the".

COLUMN 12

Line 29, change "tranfer" to read --transfer--.

COLUMN 13

Line 5, after "the" (second occurrence) insert --point a--.

Line 13, change "mull" to read --null--.

UNITED STATES PATENT AND TRADEMARK OFFICE

CERTIFICATE OF CORRECTION

PATENT NO. : 4,341,457

DATED : July 27, 1982

INVENTOR(S) : KIMIO NAKAHATA, ET AL.

It is certified that error appears in the above—identified patent and that said Letters Patent is hereby corrected as shown below:

CLAIM 11

Column 15

Line 57, change "from" to read --to--.

CLAIM 22

Column 16

Line 65, change "discharged" to read --discharger--.

UNITED STATES PATENT AND TRADEMARK OFFICE

CERTIFICATE OF CORRECTION

PATENT NO. : 4,341,457

DATED : July 27, 1982

INVENTOR(S) : KIMIO NAKAHATA, ET AL.

It is certified that error appears in the above—identified patent and that said Letters Patent is hereby corrected as shown below:

CLAIM 22 (Continued)

Column 17

Line 21, before "the" (first occurrence) insert --and wherein--; after "of" (first occurrence) delete "and wherein".

Signed and Sealed this

*Eighth* Day of *February 1983*

[SEAL]

*Attest:*

GERALD J. MOSSINGHOFF

*Attesting Officer* *Commissioner of Patents and Trademarks*